US010480269B2

(12) United States Patent
Winkler

(10) Patent No.: US 10,480,269 B2
(45) Date of Patent: Nov. 19, 2019

(54) METHOD AND APPARATUS FOR CLEARING A WELL BORE

(71) Applicant: QUANTUM DOWNHOLE SYSTEMS INC., Calgary (CA)

(72) Inventor: Steven Winkler, Cochrane (CA)

(73) Assignee: QUANTUM DOWNHOLE SYSTEMS INC., Calgary (CA)

( * ) Notice: Subject to any disclaimer, the term of this patent is extended or adjusted under 35 U.S.C. 154(b) by 61 days.

(21) Appl. No.: 14/780,703

(22) PCT Filed: Apr. 1, 2014

(86) PCT No.: PCT/CA2014/000309

§ 371 (c)(1),
(2) Date: Sep. 28, 2015

(87) PCT Pub. No.: WO2014/161073

PCT Pub. Date: Oct. 9, 2014

(65) Prior Publication Data

US 2016/0053566 A1 Feb. 25, 2016

Related U.S. Application Data

(60) Provisional application No. 61/807,584, filed on Apr. 2, 2013.

(51) Int. Cl.
*E21B 31/00* (2006.01)
*E21B 27/00* (2006.01)
(Continued)

(52) U.S. Cl.
CPC ..... *E21B 31/002* (2013.01); *E21B 27/00* (2013.01); *E21B 29/00* (2013.01); *E21B 47/06* (2013.01); *E21B 47/065* (2013.01)

(58) Field of Classification Search
CPC ..... E21B 27/00; E21B 29/00; E21B 31/002; E21B 47/06; E21B 47/065
See application file for complete search history.

(56) References Cited

U.S. PATENT DOCUMENTS 2,890,756 A * 6/1959 Middleton ..... E21B 27/00 166/107
3,057,417 A 10/1962 Sandvig
(Continued)

FOREIGN PATENT DOCUMENTS

EP 2 378 056 A2 10/2011
GB 2 335 218 A 9/1999
GB 2 468 972 A 9/2010

OTHER PUBLICATIONS

International Search Report and Written Opinion dated Jul. 7, 2014, in corresponding International PCT Application No. PCT/CA2014/000309, filed on Apr. 1, 2014 (10 pages).

*Primary Examiner* — James G Sayre
(74) *Attorney, Agent, or Firm* — Bookoff McAndrews, PLLC

(57) ABSTRACT

Methods and apparatuses are provided for clearing a wellbore using a means for milling and a means for suctioning within a wellbore. Obstructions such as ball frac seats, bridge plugs, or formation material can be milled within a wellbore. As a result, larger, unrestricted, diameters can be obtained within the liner/wellbore. The cleared wellbore can allow for various remedial tools to be run into the liner/wellbore. In addition, the milled particles can be suctioned/vacuumed up and can be pumped/pushed to surface in an underbalanced fashion. In some embodiments, this can be achieved by incorporating a bottom-hole pump or a venturi component into the bottomhole assembly. The system can be deployed using a spoolable single or multi-conduit coiled tubing system and can be configured as a well intervention
(Continued)

or work-over technology. In some embodiments, the clearing equipment can be temporary or mobile.

19 Claims, 3 Drawing Sheets

(51) Int. Cl.
*E21B 29/00* (2006.01)
*E21B 47/06* (2012.01)

(56) References Cited

U.S. PATENT DOCUMENTS

| | | | | |
|---|---|---|---|---|
| 3,291,229 | A | 12/1966 | Houston | |
| 3,887,020 | A | 6/1975 | Chaffin | |
| 4,219,087 | A * | 8/1980 | Johnson | E21B 7/28 175/213 |
| 6,006,844 | A * | 12/1999 | Van Puymbroeck | E21B 10/02 175/246 |
| 8,353,349 | B2 | 1/2013 | Hern et al. | |
| 8,727,009 | B2 * | 5/2014 | Davis | E21B 21/08 166/105.2 |
| 2003/0136584 | A1 * | 7/2003 | Risher | E21B 21/065 175/66 |
| 2009/0101340 | A1 * | 4/2009 | Jeffryes | E21B 47/06 166/250.08 |
| 2009/0173501 | A1 * | 7/2009 | Kotsonis | E21B 37/00 166/311 |
| 2012/0118571 | A1 * | 5/2012 | Zhou | E21B 27/00 166/301 |
| 2014/0326456 | A1 * | 11/2014 | Saurer | E21B 27/00 166/298 |

* cited by examiner

METHOD AND APPARATUS FOR CLEARING A WELL BORE

This application is the U.S. national phase entry under 35 U.S.C. § 371 of International PCT Application No. PCT/CA2014/000309, filed Apr. 1, 2014, which claims priority to U.S. Provisional Patent Application Ser. No. 61/807,584, filed Apr. 2, 2013, the entireties of each of which are incorporated by reference herein.

CROSS REFERENCE TO RELATED APPLICATIONS

This application claims priority of U.S. Provisional Patent Application Ser. No. 61/807,584, entitled "Method and Apparatus for Clearing a Well Bore", filed Apr. 2, 2013, and hereby incorporates the same provisional application by reference herein in its entirety.

TECHNICAL FIELD

The present disclosure is related to the field of methods and apparatuses for clearing a wellbore, in particular, methods and apparatuses for clearing a wellbore using a means for milling and a means for suctioning within a wellbore.

BACKGROUND

Since recent developments in the fields of horizontal drilling and multistage fracturing many Exploration and Production (E&P) operators have experienced difficulties utilizing current technologies to mill or drill the seats out of a ball-type frac liner system. These ball frac sleeves prevent optimal productivity of the well and restrict the E&P company from entering the liner of the wellbore. Recent developments indicate that an intervention is required to remove the restrictions (balls and seats), to investigate inflow (production log or production evaluate), to restimulate the reservoir, and/or remove blockages such as sand or formation material.

Currently, the technology being used in these situations is typically conventional coiled tubing, water nitrogen mixtures, and mud motors with drill-bits or mills. These systems can increase the diameter of the liner by removing balls, seats, or other obstructions to achieve a maximum inner diameter of the liner. Current processes, however, create an over-balanced effect/position on the reservoir which in turn can lead to a loss of work-over fluids. A loss of work-over fluids will result in the undesired effect of frac proppant (sand) coming out of suspension and 'sanding-in' tools and tubing so that it cannot be removed. Sanding-in can result in the loss of tools, expensive fishing requirements, and potentially the loss of production from the well which can no longer be accessed. This over-balanced effect can also lead to formation damage resulting in reduced inflow from the formation or reservoir. The wellbore is often left with many of the solids from the seats, frac proppant (sand) and formation fines still present and not cleared from the liner. This limits the E&P company from getting the well to reach its maximum productivity and gather valuable data that would facilitate optimal development of a given field.

For E&P companies who are presently doing these operations, the cost and supply of nitrogen can seriously impact the economics and overall outcome. Safety is also major concern for E&P companies using current systems and the operations environment can be categorized as moderate to high risk. The reason for the safety concern is that the injection lines, coiled tubing, and return lines contain a highly compressible gas (typically nitrogen) and can be under extreme pressure. If a pressurized line or tubing is to part or break, the energy stored in the volume of the lined has to bleed off. This bleeding can cause the lines to whip uncontrollably until the energy has bled off. The uncontrolled lines can, in turn, contact and injure personnel and/or damage other equipment. The choice fluid/gas mixture typically used during current operations is low in density to maintain high velocity, this in turn is also known to wash out the surface iron (coiled tubing reel) and flow back vessel manifolds and connections.

Accordingly, there is a need to provide apparatuses and methods for clearing a wellbore that can overcome the short-comings of the prior art, such as unstable job costs, potential for formation damage, and unsafe work environments.

SUMMARY

Methods and apparatuses are provided for clearing a wellbore using a means for milling and a means for suctioning within a wellbore. Obstructions such as balls, seats, bridge plugs, or formation material can be milled within a wellbore. As a result, larger, unrestricted, diameters can be obtained within the liner/wellbore. The cleared wellbore can allow for various remedial tools to be run into the liner/wellbore. In addition, the milled particles can be suctioned/vacuumed up and can be pumped/pushed to surface in an underbalanced fashion. In some embodiments, this can be achieved by incorporating a bottom-hole pump or a venturi component into the bottomhole assembly. The system can be deployed using a spoolable single or multi-conduit coiled tubing system and can be configured as a well intervention or work-over technology. In some embodiments, the clearing equipment can be temporary or mobile.

In some embodiments, the apparatus can be a closed-loop system for milling obstructions from a wellbore and it can comprise: a multiple conduit coiled tubing, a first conduit for delivering fluid to a mud motor or hydraulic gear motor powering a mill/bit and a second conduit for returning fluid and cuttings (in some cases) to the surface; a bridge between the conduits at the mill/bit that allows fluid communication between the two conduits; and a venturi-type device that creates suction to pump fluid, cuttings, and/or frac sand from the mill/bit to the surface of the wellbore. In some embodiments, a mechanical pump (such as a twin screw pump or a progressive cavity pump) can be used to provide the suction in place of, or in addition to the venturi-type device.

The operation of the system can be such that power fluid (namely fluid for driving the mud motor, gear motor, or venturi) delivered through the mud motor or hydraulic gear motor can be redirected towards the surface at a bridge point proximate or at the mill/bit. In order to obtain underbalanced pressure, a venturi or pump device can be used to suction/pump the fluid and cuttings to the surface.

In some embodiments, an additional feature of the apparatus and methods can be to vacuum up the milled particles and pump/push them to surface in an underbalanced fashion. This can be done by incorporating a venturi into the bottomhole assembly to create a suction effect.

The apparatus and methods can be deployed using a spoolable multi-conduit coiled tubing, one conduit can be used for supplying power fluid and the second for returning power fluid as well as wellbore fluid and/or solids. In some embodiments, the apparatus and methods can be a closed-loop system that allows for the recovery of the fluid, whereas prior art systems do not recover the fluid.

Broadly stated, in some embodiments, an apparatus is provided for clearing material from within a wellbore comprising: a means for milling the material within the wellbore; and a means for suctioning the milled material out from the wellbore, the means for suctioning operatively attached to the means for milling; wherein the material can be cleared from within the wellbore.

Broadly stated, in some embodiments, a method is provided for clearing material from within a wellbore comprising: milling the material within the wellbore; and suctioning the milled material out from the wellbore; thereby clearing the material from within the wellbore.

DETAILED DESCRIPTION OF EMBODIMENTS

Methods and apparatus for clearing a wellbore are provided.

Figure 1:
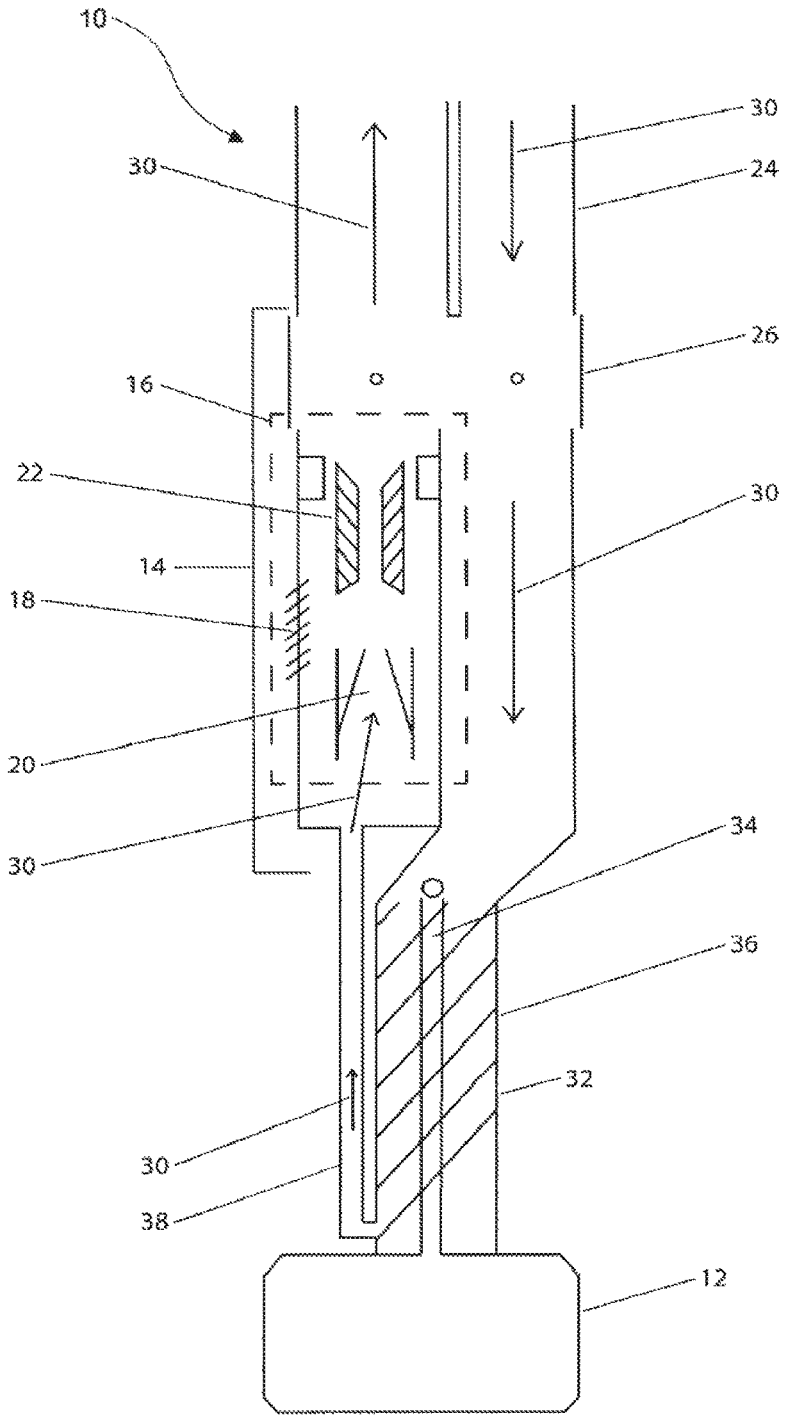
FIG. 1 is a side elevation cross-section view depicting an embodiment of an apparatus for clearing a wellbore.
Figure 2:
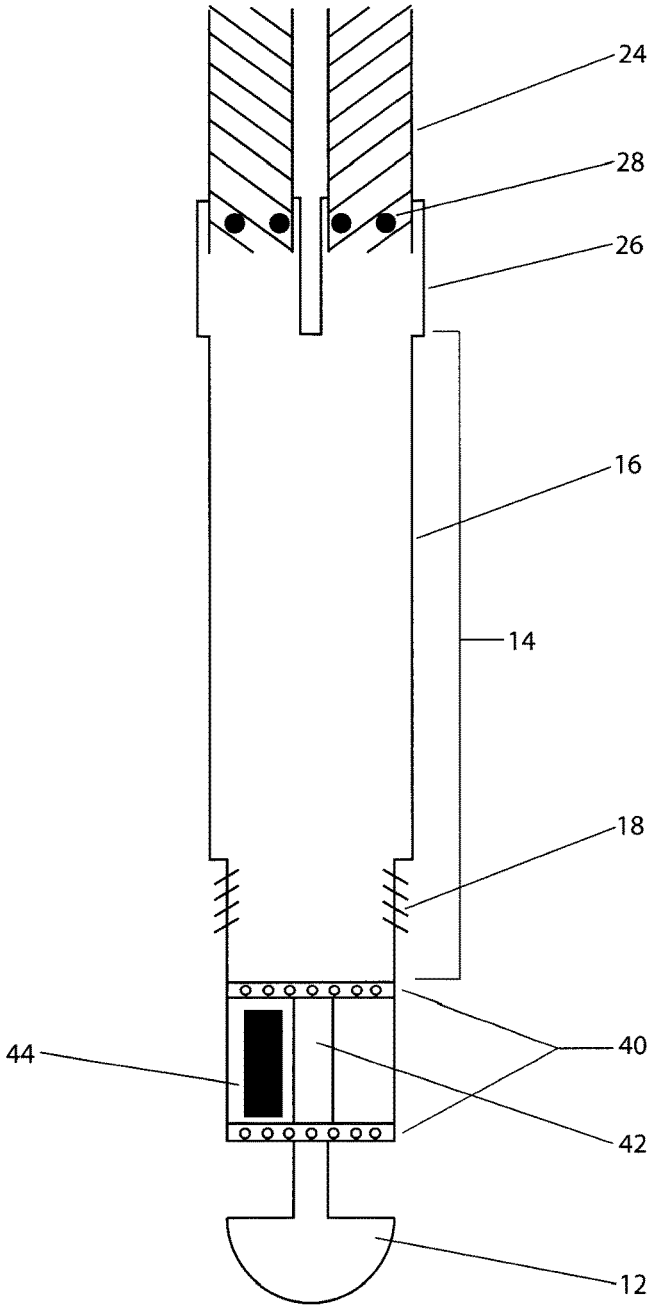
FIG. 2 is a side elevation cross-section view depicting a further embodiment of an apparatus for clearing a wellbore.

Referring now to FIG. 1 and FIG. 2, an apparatus 10 is shown. In some embodiments, apparatus 10 can comprise a means for milling 12 material (not shown) in a wellbore (not shown) and a means for suctioning 14 the material. The term milling, as used herein, can also mean drilling, and the reverse is also true. The term suctioning, as used herein, can also mean vacuuming, and the reverse is also true. In some cases, means for milling 12 and means for suctioning 14 can be integral and/or in-line with each other.

In some embodiments, means for milling 12 can be a mill or a bit, as would be known to one skilled in the art. In some embodiments, means for suctioning 14 can be a venturi component 16 or a bottomhole (or progressive cavity or twin-screw artificial lift system (ALS)) pump $\mathbf{16}^1$ as would be known to one skilled in the art. Means for suctioning 14 can comprise an intake 18 to bring milled particles and/or fluid and/or frac sand (proppant) into apparatus 10. Venturi component 16 can comprise a nozzle 20 and a mixing tube 22.

The apparatus and methods can be deployed using a spoolable coiled tubing 24, which can be single-conduit coiled tubing or multi-conduit coiled tubing. In multi-conduit embodiments, one conduit can be used for providing power fluid and a second conduit for returning power fluid as well as wellbore fluid and/or solids. Coiled tubing 24 can be connected to means for milling 12 and/or means for suctioning 14 by connector element 26. In some embodiments, connector element 26 can be fastened by set screws 28.

In some embodiments, the apparatus and methods can be a closed-loop system that allows for the recovery of fluid 30, whereas prior art systems do not recover the fluid. In some embodiments, fluid 30 can be a non-compressible fluid. In some embodiments, fluid 30 can be water which is considered low risk. In some embodiments, fluid 30 can be oil.

Referring to FIG. 1, flow of fluid 30 is demonstrated by arrows within a closed-loop. Fluid can flow from coiled tubing 24, through connector element 26 into a mud motor or hydraulic gear motor 32 (having a mud motor rotor 34 and a mud motor stator 36) to power means for milling 12, back through fluid flow connection 38, into nozzle 20 of venturi 16, through mixing tube 22 of venturi 16, then back through coiled tubing 24 to as clean fluid 30 to surface (not shown).

Referring now to FIG. 2, in some embodiments, means for milling 12 can comprise a bit, bearing assembly 40 and drive shaft 42 driven by a rotor of bottomhole pump $\mathbf{16}^1$ to allow for means for milling 12 to mill downhole material within a wellbore.

In some embodiments, apparatus 10 can comprise bottomhole pressure and/or temperature recorders 44 to record readings in order to monitor the functioning of apparatus 10 and the clearing of the material from the wellbore. In some embodiments, apparatus 10 can also comprise controlling means for controlling the means for suctioning or the means for milling in light of recordings from the recorders.

Figure 3:
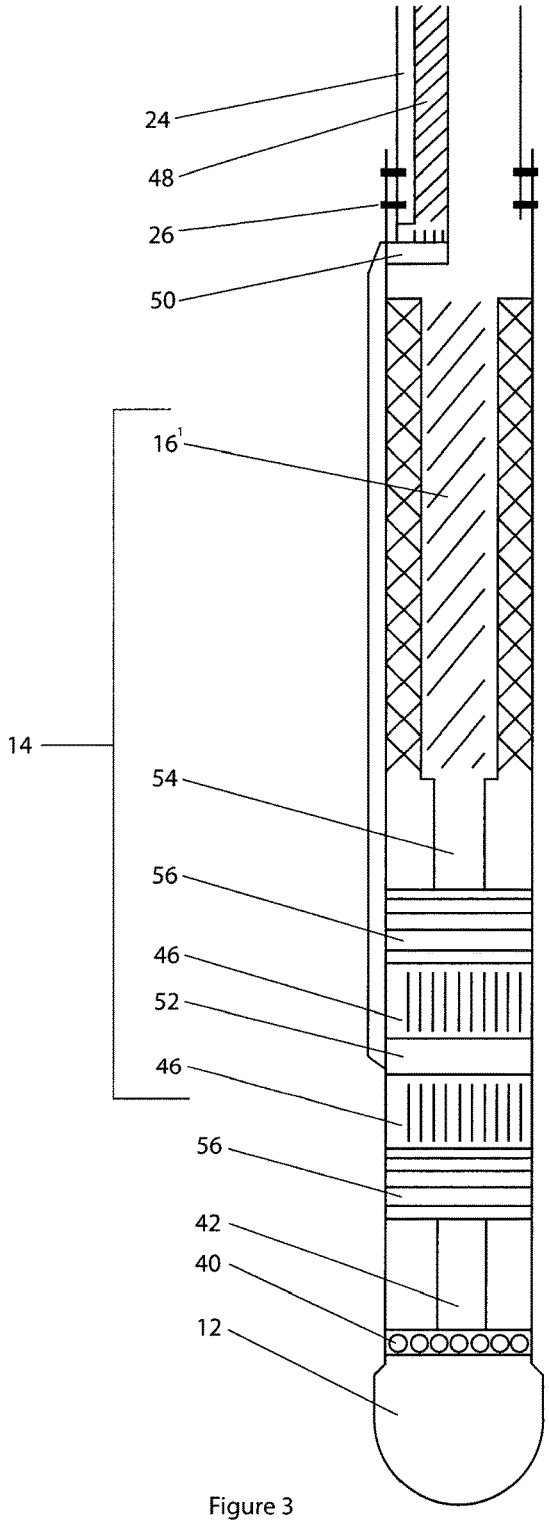
FIG. 3 is a side elevation cross-section view depicting a further embodiment of an apparatus for clearing a wellbore.

Referring now to FIG. 3, in some embodiments, one or more down-hole electric motors 46 can be powered through an electrical conductor cable 48 connected to apparatus 10 through electrical cable head connector 50 and electric termination box 52. In some embodiments, electric termination box 52 can further comprise an invertor and/or transformer.

In some embodiments, means for suctioning 14 can comprise a driveshaft with deflection compensator 54 with axial load bearing. An electric motor 46 can power driveshaft with deflection compensator 54 through gear box 56 to provide suction action. In some embodiments, an electric motor 46 can power drive shaft 42 through gear box 56 to provide milling action.

In some embodiments, apparatus 10 can further comprise an electromagnetic component (not shown) and a junk basket (not shown) to attract and collect material/items (for example, metal filings) though magnetism. The collected material/items can be separated from the fluid within apparatus 10 as to not impede or destroy the function of apparatus 10.

In some embodiments, means for milling 12 can be configured to mill particles down to a predetermined size small enough so that means for suctioning 14 can transport the particles to the surface.

The operation of the system can be such that power fluid 30 delivered through the mud motor 32 can be redirected towards the surface at a bridge point at, or proximate, the mill/bit, in some cases for the purpose of lubrication of means for milling 12. In some embodiments, the apparatus and methods can vacuum up the milled particles and pump/push them to surface in an underbalanced fashion, 'underbalanced' meaning removing more fluid from the wellbore than is being put into it from the surface. In contrast, prior art methods and devices use an overbalanced position, meaning more fluid is being put into the well then is being taken out of it. In order to obtain underbalanced pressure, a venturi component 16 or mechanically driven bottomhole pump $\mathbf{16}^1$ can be used to suction/pump the fluid and cuttings to the surface.

Clearing a material from within a wellbore can be accomplished by milling the material within the wellbore and suctioning the milled material out from the wellbore. In some embodiments, the milling and the suctioning can be performed simultaneously. In some embodiments, fluid can be provided to the material to assist in milling and suctioning the material. In some embodiments, pressure and temperature in the wellbore can be recorded to monitor the clearing of the material. In some embodiments, the fluid and the material can be removed from the wellbore. In some embodiments, the fluid can be cleaned by separating it from the material, in some cases through magnetism, whereby the fluid can be reused. In some embodiments, the cleared fluid is reused.

The scope of the claims should not be limited by the embodiments as set forth in the examples herein, but should be given the broadest interpretation consistent with the description as a whole.

Although a few embodiments have been shown and described, it will be appreciated by those skilled in the art that various changes and modifications can be made to the embodiments described herein. The terms and expressions used in the above description have been used herein as terms of description and not of limitation, and there is no intention in the use of such terms and expressions of excluding equivalents of the features shown and described or portions thereof, it being recognized that the invention is defined and limited only by the claims that follow.

While the above description details certain embodiments of the invention and describes certain embodiments, no matter how detailed the above appears in text, the invention can be practiced in many ways. Details of the apparatuses and methods may vary considerably in their implementation details, while still being encompassed by the invention disclosed herein. These and other changes can be made to the invention in light of the above description.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification.

Accordingly, the actual scope of the invention encompasses not only the disclosed embodiments, but also all equivalent ways of practicing or implementing the invention.

The above description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. The elements and acts of the various embodiments described above can be combined to provide further embodiments.

While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention.

I claim:

1. An apparatus for clearing a material from within a wellbore comprising:

a milling component for milling the material within the wellbore, the milling component comprising a mill or a drill bit; and a suctioning component for suctioning the milled material out from the wellbore, the suctioning component comprising a venturi component or a pump, wherein the milling component and the suctioning component are coupled together and deployed within multiple conduit coiled tubing as a bottomhole assembly to form a closed loop system, the multiple conduit coiled tubing having a first conduit configured for delivering fluid to the milling component and a second conduit configured for removing the fluid and the material from the wellbore, and a bridge between the conduits proximate the milling component for fluid communication between the first and second conduits, and wherein the material can be cleared from within the wellbore.

2. The apparatus of claim 1 wherein the suctioning component comprises an intake to bring the material into the apparatus.

3. The apparatus of claim 1 wherein the suctioning component and the milling component are in-line with each other.

4. The apparatus of claim 1 further comprising a connector for fluidly connecting the apparatus to the multiple conduit coiled tubing.

5. The apparatus of claim 4 wherein the connector comprises at least one set screw for connecting the apparatus to the multiple conduit coiled tubing.

6. The apparatus of claim 4 further comprising the multiple conduit coiled tubing attached to the connector configured for supplying the fluid to the apparatus.

7. The apparatus of claim 4 further comprising the multiple conduit coiled tubing attached to the connector configured for removing the fluid and the material from the wellbore to the surface.

8. The apparatus of claim 1 further comprising bottomhole recorders attached to the suctioning component or the milling component, the recorders for recording pressure or temperature readings in order to monitor the functioning of the apparatus and the clearing of the material from the wellbore.

9. The apparatus of claim 1 further comprising a cleaning component for cleaning fluid removed from the wellbore by separating the fluid from the material whereby the fluid can be reused, the cleaning component being in-line with the suctioning component.

10. A method for clearing a material from within a wellbore comprising:

positioning an apparatus for clearing the material at or near the bottomhole assembly within the wellbore, the apparatus deployed within multiple conduit coiled tubing and forming a closed loop system including a milling component coupled to a suctioning component, wherein fluid is delivered to the milling component via a first conduit of the coiled tubing and the fluid and the material is removed by the suctioning component via a second conduit of the coiled tubing;

milling, via the milling component, the material within the wellbore; and suctioning, via the suctioning component, the material out from the wellbore;

thereby clearing the material from within the wellbore.

11. The method of claim 10 wherein the milling and the suctioning are performed simultaneously.

12. The method of claim 10 further comprising the step of:

providing the fluid to the material to assist in milling and suctioning the material.

13. The method of claim 12 further comprising the step of:

cleaning the fluid by separating it from the material whereby the fluid can be reused.

14. The method of claim 10 further comprising the step of:

recording pressure and temperature in the wellbore, to monitor the clearing of the material.

15. An apparatus for clearing a material from within a wellbore comprising:

a milling component for milling the material within the wellbore, the milling component comprising a mill or a drill bit; and a suctioning component for suctioning the milled material out from the wellbore, the suctioning component comprising a venturi component or a pump, wherein the milling component and the suctioning component form a closed loop system, the system deployed into the wellbore via a multiple conduit coiled tubing, a first conduit configured for delivering fluid to the milling component and a second conduit configured for removing the fluid and the material, via the suctioning component, from the wellbore, and a bridge between the conduits proximate the milling component that allows fluid communication between the two conduits, wherein the material can be cleared from within the wellbore in an underbalanced fashion.

16. The apparatus of claim 15, the apparatus further comprising a connector for fluidly connecting the apparatus to the coiled tubing.

17. The apparatus of claim 16, wherein the connector comprises at least one set screw for connecting the apparatus to the coiled tubing.

18. The apparatus of claim 16 further comprising coiled tubing attached to the connector configured for supplying the fluid to the apparatus.

19. The apparatus of claim 16, further comprising coiled tubing attached to the connector configured for carrying the fluid away from the apparatus.

* * * * *